United States Patent [19]

Bader

[11] Patent Number: 4,634,371

[45] Date of Patent: Jan. 6, 1987

[54] INTERMEDIARY CHANNEL FOR A FEEDING DEVICE FOR A PULSATORY COMBUSTION CHAMBER

[75] Inventor: Jean-Marc Bader, Morssant, France

[73] Assignees: Societe Nationale Elf Aquitaine, Courbevoie, France; Marek B.V., Amsterdam, Netherlands

[21] Appl. No.: 717,665

[22] Filed: Mar. 29, 1985

[30] Foreign Application Priority Data

Mar. 29, 1984 [FR] France ..... 84 04919

[51] Int. Cl.[4] ..... F23C 9/00

[52] U.S. Cl. ..... 431/116; 431/1; 60/39.52; 60/39.76; 123/568

[58] Field of Search ..... 431/1, 115, 116, 215; 123/59 BM, 531, 545, 568, 570; 122/24; 60/39.52, 39.76, 39.77, 736

[56] References Cited

U.S. PATENT DOCUMENTS

| | | | |
|---|---|---|---|
| 1,539,126 | 5/1925 | Link | 123/568 X |
| 2,898,978 | 8/1959 | Kitchen et al. | 431/1 |
| 3,177,663 | 4/1965 | Black | 60/398 X |
| 3,848,408 | 11/1974 | Tompkins | 60/398 X |
| 4,007,002 | 2/1977 | Schirmer | 431/352 X |
| 4,083,674 | 4/1978 | Holzapfel | 431/116 |
| 4,327,698 | 5/1982 | Hamai et al. | 123/568 |
| 4,457,690 | 7/1984 | Saito et al. | 431/1 |

FOREIGN PATENT DOCUMENTS

| | | | |
|---|---|---|---|
| 951829 | 10/1956 | Fed. Rep. of Germany | 1/ |
| 975546 | 12/1961 | Fed. Rep. of Germany | 431/1 |
| 1149335 | 5/1963 | Fed. Rep. of Germany . | |
| 1240612 | 5/1967 | Fed. Rep. of Germany | 431/1 |
| 2507129 | 9/1976 | Fed. Rep. of Germany | 431/115 |
| 2508770 | 9/1976 | Fed. Rep. of Germany . | |
| 647396 | 11/1928 | France | 123/545 |
| 550738 | 9/1956 | France | 431/116 |
| 2004331 | 11/1969 | France | 431/1 |
| 2069688 | 3/1971 | France . | |
| 38514 | 3/1984 | Japan | 431/1 |
| 81/01454 | 5/1981 | PCT Int'l Appl. . | |
| 419409 | 3/1967 | Switzerland . | |
| 430634 | 6/1935 | United Kingdom | 123/545 |

*Primary Examiner*—Margaret A. Focarino
*Attorney, Agent, or Firm*—Oblon, Fisher, Spivak, McClelland & Maier

[57] ABSTRACT

An intermediary chamber associated to a device for feeding a pulsatory combustion chamber with fuel and comburent includes a heat tube 165 defining with the inner channel wall 125 a recirculation zone for the burnt gases issuing from the combustion chamber. The intermediary channel located between the combustion chamber for pulsatory combustion of a mixture of fuel and a combustive agent and an injection chamber includes the heat tube being directly communicated with the combustion chamber, wherein an internal wall of the intermediary channel and an outer surface of the heat tube define a recirculation zone for the recirculaton of burn gases issuing from the combustion chamber, the recirculation zone being at least partially open at an upper end thereof.

11 Claims, 9 Drawing Figures

INTERMEDIARY CHANNEL FOR A FEEDING DEVICE FOR A PULSATORY COMBUSTION CHAMBER

BACKGROUND OF THE INVENTION

1. Field of the Invention

The present invention concerns an intermediary channel or chamber for a fuel and combustive agent feeding device for a pulsatory combustion chamber, i.e. a chamber formed by a channel which is located between the chamber where injection occurs and the combustion chamber where the pulsatory combustion takes place.

2. Background of the Invention

P.C.T. patent application No. 81 01454 for "Starting Method and Device for Combustion Apparatus" describes a device comprising a combustion chamber topped by a feeding device between which parts is located an intermediary channel substantially at the level of a second conical part of a tube that surrounds the injection head. According to this P.C.T. patent application, the intermediary channel is provided with an inner tube, also called heat tube. The inner wall of the intermediary channel and the heat tube define an annular space which is open at its lower portion, but is closed at its upper portion.

This heat tube principally allows the fuel to be vaporized before entering the combustion chamber. For this purpose said heat tube must be maintained at a relatively elevated temperature. One possible drawback of such a device is that if soot, might become deposited therein, particularly at the level of the injection head. Generally, such deposit is due to excessively high temperatures.

The present invention is aimed at providing an intermediary channel provided with a heat tube which, while being maintained at a high temperature, yet which prevents soot from being deposited in the chamber wherein injection takes place.

SUMMARY OF THE INVENTION

To this end, the invention provides an intermediary channel located between a combustion chamber for pulsatory combustion of a mixture of a combustive agent and fuel and an injection chamber for injection of said mixture, said intermediary channel being provided with a heat tube, wherein the inner wall of said intermediate channel and said heat tube delimit a recirculation zone for recirculating the burned gases issuing from said combustion chamber, said recirculation zone being at least partially open at its upper end. Due to this novel arrangement according to the invention, the recirculation of the hot gases allows the heat tube to be maintained at a temperature high enough for the fuel to be vaporized, while yet limiting the heat transfer toward the injection chamber, since the recirculation zone is partially open at its upper end.

Preferably, the intermediary channel comprises a lower portion located in the vicinity of said combustion chamber and an upper portion located in the vicinity of said injection chamber, said heat tube being located in said lower channel portion. Preferably, these two channel portions are cylindrical, the lower portion having a larger diameter than the upper portion and said two portions being connected to each other by a flange in front of which is located the upper end of said heat tube.

The flange can be flat or rounded and preferably comprises, in its peripherical zone of smallest diameter, a circular projection or protrusion the maximum diameter of which is smaller than the inner diameter of said heat tube. Said circular projection can be vertical and can be inclined either towards the outside of the intermediary channel or chamber or towards the inside thereof.

In its lower portion, the intermediary channel can be provided with an insulating sleeve coaxial to the heat tube, which is made of a thermally insulating material.

In another embodiment the upper portion of said intermediary channel is provided with a cylindrical sleeve, the inner diameter of which is smaller than that of said heat tube, and the lower edge of which forms the protrusion of the flange.

The cylindrical sleeve of the upper portion can be maintained in place by a series of rings which are located inside of an external cylindrical jacket and which bear on an annular flat surface of said jacket.

Preferably, some of these rings are made of thermally insulating material and/or define insulating at least one annular isolating space or interval.

BRIEF DESCRIPTION OF THE DRAWINGS

A more complete appreciation of the invention and many of the attendant advantages thereof will be readily obtained as the same becomes better understood by reference to the following detailed decription when considered in connection with the accompanying drawings, wherein.

DETAILED DESCRIPTION OF THE PREFERRED EMBODIMENTS

Figure 1:
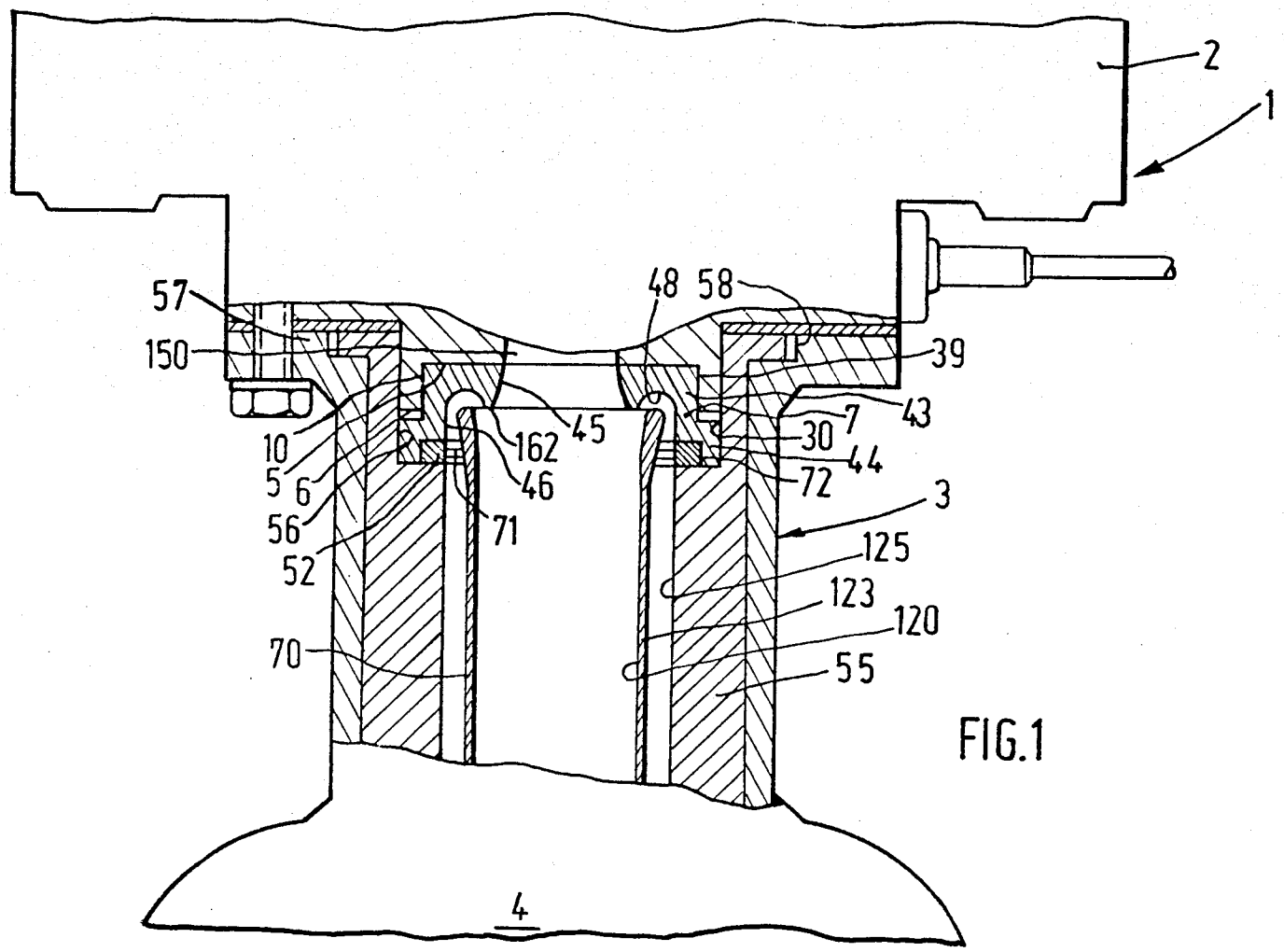
FIG. 1 is a partial sectional view of a first embodiment of the invention.

The device 1 represented in FIG. 1 comprises a body 2 fitted on the neck 3 of a pulsatory combustion chamber 4. Body 2 includes a fuel/combustive agent mixture injection chamber 150 in which is located an injection head 115. Injection chamber 150 is delimited at its lower portion by a circular surface 5, an annular surface 6 and a wall 10, which define a cylindrical bore 39 adapted to receive a disc 7.

Said disc 7 comprises two coaxial cylindrical parts 43 and 44, a central bore 45, a second central bore 46 and a circular groove 48. Lower cylindrical part 44 has a diameter greater than that of upper cylindrical part 43 and is fitted in the bore 30 of a sleeve 55. Thus disc 7 is maintained in position between sleeve 55 and the lower end of injection chamber 150. A combustion chamber is indicated by reference number 4.

The upper part 43 of disc 7 and its central bore 45 constitute the upper portion of the intermediary channel, which upper channel portion is connected to the lower portion by groove 48 defining a connecting flange between said two channel portions.

Central bore 45 is conical, and its upper end diameter is equal to the small diameter of the injection chamber.

The walls of groove 48 and central bore 45 are connected to each other by a flat annular surface, so as to define a circular protrusion 162.

Cylindrical sleeve 55 is mounted within neck 3 and comprises an upper bore 56 and a flange 57 which is fitted in a complementary bore 58 of neck 3. The outer diameter of sleeve 55 is equal to the inner diameter of neck 3, fitting clearance or tolerances being taken into account.

Figure 2:
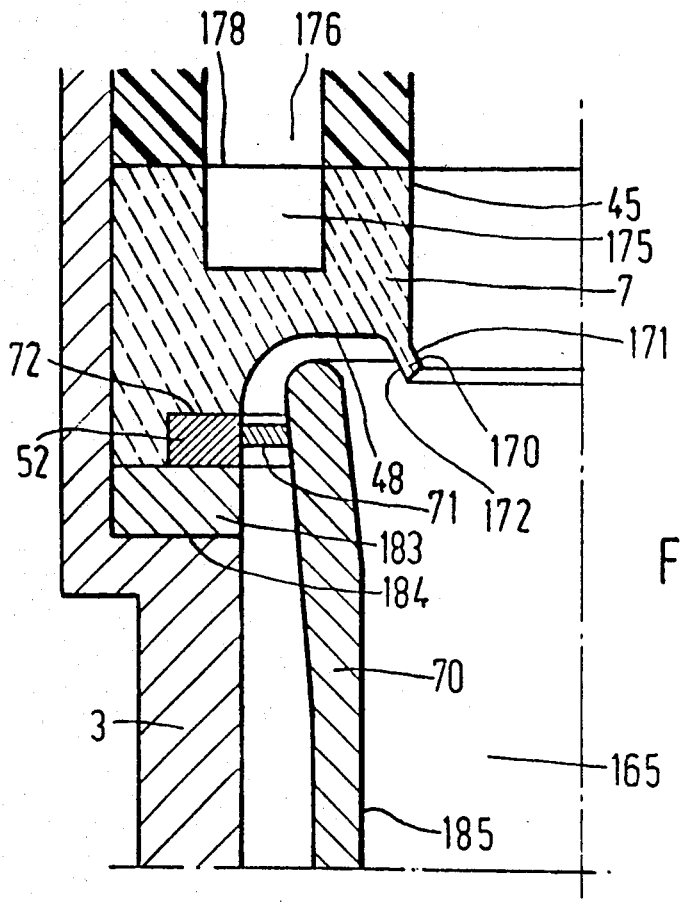
FIG. 2 is a detailed view of a variant of the device of FIG. 1.
Figure 2A:
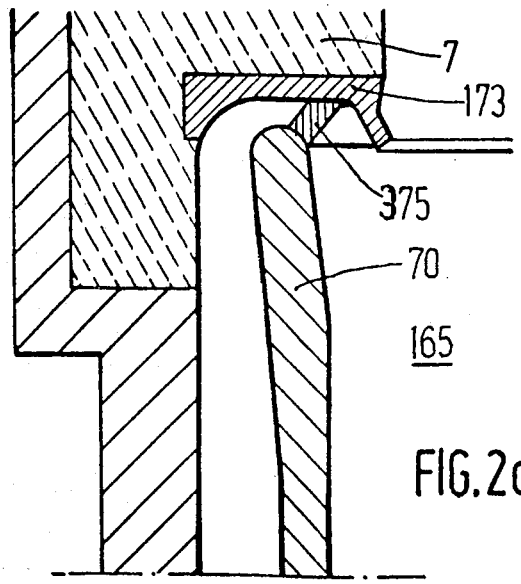
FIG. 2*a* shows a modification of the detail of FIG. 2.

Located in cylindrical sleeve 55 is a heat tube 165 shown in FIG. 2*a* in the form of a cylindrical jacket 70, which is maintained in position by four fixing pads 71 crimped in a bearing crown 52 interposed between bore 56 and a circular groove 72 of disc 7.

In the device shown in FIG. 1 disc 7 is made of graphite, sleeve 55 is made of an isolating ceramic material, the remaining elements being made essentially of metallic material.

Under normal service conditions—i.e. disregarding the combustion initiation phase—the device operates as follows:

Fuel is injected in a manner known per se into the injection chamber by means of an injector, with a sprinkling cone so selected that the impact of the fuel droplets takes place mostly below the upper level of jacket 70.

The lower portion thereof then constitutes the fuel/-combustive agent mixing zone, although part of the mixing may already have taken place in the lower collector or injection chamber zone, or may take place, on the contrary, within combustion chamber 4.

As is well known by those skilled in the art, the explosion phase of a pulsatory combustion process includes a pressure increase in the combustion chamber, followed by the expulsion of the burnt gases toward the exhaust system. However, part of the burnt gases will be forced back toward the top of the device, in the direction of injection chamber 150. In accordance with the invention this part of the burnt gases can be used to heat the heat tube to a sufficiently elevated temperature. Indeed the outer surface 123 of jacket 70, the inner wall 125 of sleeve 55 and groove 48 define an annular gas recirculation channel.

This channel has a shape converging toward the inside portion of groove 48. During recompression the burnt gases thus are accelerated upwardly, then deviated downwardly. Acceleration of the gases in the downward direction is enhanced by the provision of circular protrusion 162 which allows to generate a tromp effect at the outlet of bore 45.

Due to this recirculation of the hot burnt gases the heat tube 165 is heated to a temperature which enables it to support the evaporation of the fuel droplets impinging on said heat tube. Indeed, in the absence of such evaporation effect these droplets would agglomerate as they move downwardly toward the combustion chamber 4 which they would then enter in shape unsuitable for complete combustion. Thus the vaporization effect obtained due to the elevated temperature of the tube will combine with that obtained by the recirculation of the gases which sweep the inner wall 20 jacket 70 so as to limit the impact of the liquid fuel droplets onto the wall.

Furthermore, as shown in FIG. 1, the upper portion of the heat tube is flared so that at the outlet of circular groove 48 the direction changing zone of the recirculated gases substantially constitutes a convergent conduit tapering toward the inner wall 120 of heat tube 165.

FIG. 2 shows a detail of a variant of the device of FIG. 1. In this embodiment central bore 45 of disc 7 is cylindrical and terminates by a protrusion 170 the outer surface 171 and inner surface 172 are conical and directed toward the inside of heat tube 165. Disc 7 has an annular recess 175 of rectangular section. The lower portion of injection chamber 150 is provided, too, with an annular recess 176 having the same width. Annular recesses 175 and 176 are facing each other so as to define any empty closed annular chamber 178. Said chamber 178 constituutes a heat isolating cushion which limits the heat transfer from heat tube 165 toward the upper portion of the device. As shown in FIG. 2, neck 3 is not provided with a sleeve, whereby the gas recirculation channel is defined directly by the inner wall of neck 3. The bearing or supporting crown 52 to which are affixed fixing pads 71 is maintained in position in groove 72 by an intermediary disc 183 which, in turn bears on an annular surface 184 of neck 3.

This figure furthermore shows that the annular surface 185 itself of jacket 70 is cylindrical, at least as far as its lower portion is concerned.

On the device shown in FIG. 2, as already set forth herein-above, ring 7 is made of graphite or ceramic material. Due to the nature of said ring and the small size of fixing pads 71, heat transfer from the sleeve upwardly is limited. Thus said sleeve is maintained at an elevated temperature.

However, another embodiment may be envisaged, which allows the upper portion of the recirculation channel to be maintained at an elevated temperature, so that the recirculated gases are not cooled. Such embodiment is illustrated by FIG. 2*a*. In front of sheath or jacket a 70 ring 7 made of graphite or ceramic material is provided with a ring member 173 made of heat conductive material, such as stainless steel. Sheath or jacket 70 constituting the heat tube is fixed directly to ring member 173 by fixing pads made of stainless steel, as shown at 375.

Figure 3:
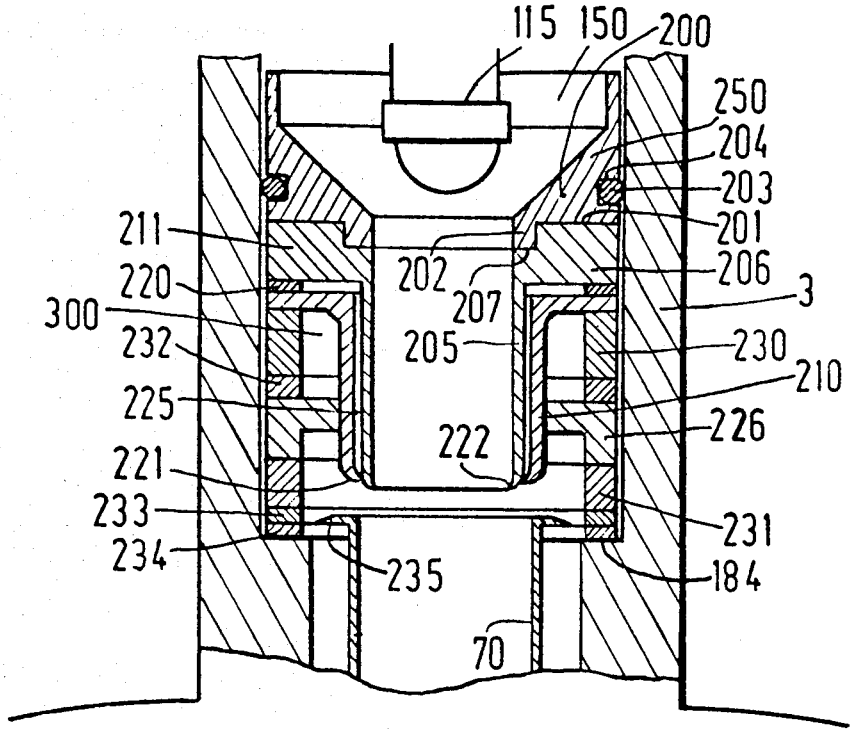
FIG. 3 is a sectional view of a second embodiment of the invention.

FIG. 3 shows another embodiment of the invention, which is particularly adapted to be used when air is injected in a vertical direction. Similar components used in the embodiments of FIGS. 1, 2 and 3, respectively, are designated by identical reference numerals.

The lower portion of injection chamber 150 in which an injector 115 is located is delimited by a first ring 200 having a substantially triangular profile and the lower surface 201 of which is planar and comprises an annular protrusion 202. An O-ring 203 is placed in a groove 204 and engages neck 3.

A cylindrical sleeve 205 is mounted below ring 200 and comprises an upper annular flange 206 the outer diameter of which is equal to that of ring 200, and an annular notch 207 the profile of which corresponds to that of protrusion 202. Sleeve 205 is mounted in a second sleeve 210 the inner diameter of which is slightly greater than the outer diameter of sleeve 205, and which comprises an annular flange 211. A flat ring 220 is interposed between this annular flange 211 and flange 206 of sleeve 205. The lower end 221 of second sleeve 210 is rounded toward the first sleeve 205 and engages the same. Thus sleeve 205 is surrounded by an air jacket 225. Its outer diameter is smaller than the inner diameter of the heat tube.

The lower end 222 of sleeve 205 is located at a level slightly below that of the lower end of 221 of second sleeve 210. This end 222 is narrowed so as to define a inwardly converging rim portion.

Sleeve 210 is maintained in position in neck 3 by a disc 226 which is blocked between annular flange 211 and annular surface 184 by means of rings 230 and 231 and washers 232, 233 and 234 that define annular isolating spaces or intervals 300.

Sheath or jacket 7 which is cylindrical over its entire height, comprises a flange 235 that engages washer 234.

Figure 4B:
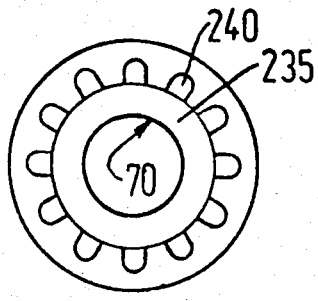
FIGS. 4*a* and 4*b* show details of the structure of FIG. 3.
Figure 4A:
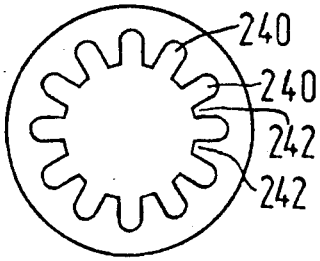

Washer 234 is shown in detail in FIGS. 4*a* and 4*b*. Its outer diameter is substantially equal to the inner diameter of neck 3, while its inner diameter is greater than the outer diameter of tube or jacket 70, while being smaller than the maximum diameter of flange 235. Washer 234 is provided with a plurality of elongated apertures 240 extending radially from its inner periphery Said apertures define between them tongues 242 which engage flange 235 (cf. FIG. 4*b*).

In the present embodiment as shown in FIG. 3 the following materials are selected for manufacturing the various elements: Sleeves 205 and 210, the two rings 230 and 231 and disc 226 are made of graphite, whereas flat ring 220 and washer 232 are made of asbestos. This allows to limit efficiently the heat transfer by conduction toward the upper portion of the device, i.e. toward the injection chamber.

Referring to FIG. 3, it will be noted that the lower end of sleeve 205 is located below the inlet face of the heat tube, and that the minimum inner diameter of said sleeve is smaller than the inner diameter of said heat tube, whereby the assembly formed by these components defines, in combination with lower disc 226, the upper portion of the recirculation zone of the hot gases issuing from the combustion chamber.

Figure 5:
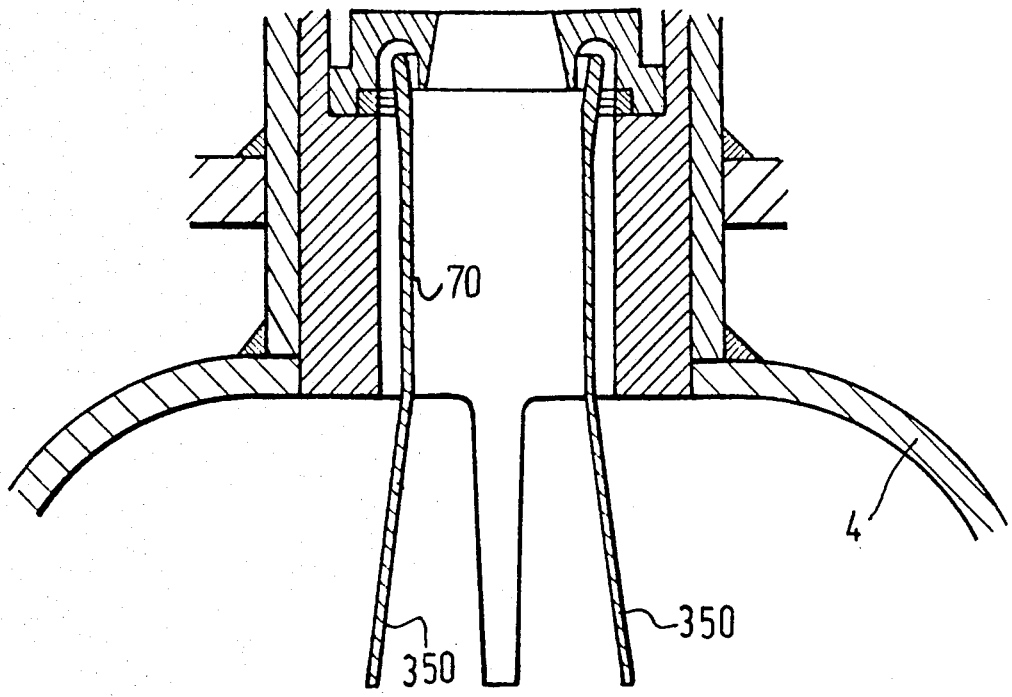
FIG. 5 is a partial view of a modified embodiment of the invention.

FIG. 5 shows another variant of the device according to the invention, and more particularly of the device represented in FIG. 1. In this variant, jacket or sheath 70 of the heat tube 165 is extended at its lower end by a series of four pads 350 extending inwardly of combustion chamber 4. Said pads facilitate the temperature rise of jacket 70 during combustion initiation, since they allow heat transfer to take place between the central portion of chamber 4 and jacket or sheath 70.

Figure 6:
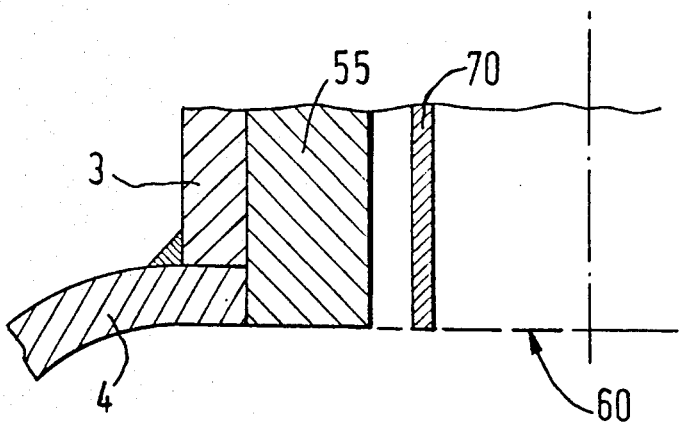
FIG. 6 shows a detail of the lower channel portion.

FIG. 6 shows another embodiment of the lower portion of the intermediary channel. As shown in this figure, neck 3 is welded onto combustion chamber 4. Sheath or jacket 70 and sleeve 55 extend within the neck, up to a higher level of combustion chamber 4, in such a manner that the lower faces of the sleeve and the jacket are located in the plane 60 containing the intersection of chamber 4 and the inner space of the neck.

Figure 7:
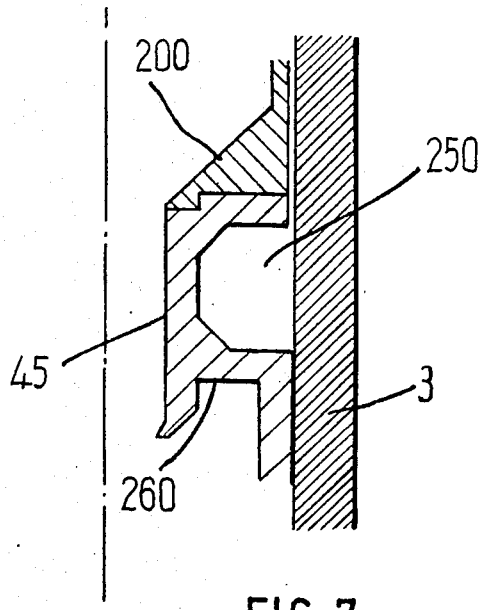
FIG. 7 shows a modification of the structure of FIG. 1.

FIG. 7 shows another embodiment of disc 7. Central bore 45 of said disc is cylindrical. The disc is mounted in ring 200 and directly engages the inner surface of neck 3; said disc comprises an annular recess 250 constituting a sealed heat insulation chamber. In this variant, as in the one shown in FIG. 3, the flange connecting the upper portion of the intermediary channel to the lower portion thereof does not define a rounded groove, but a groove having a prism-shaped section the upper surface 260 of which is horizontal. Said groove may have any other convenient profile; more particularly it may, for example, have an inclined upper surface so as to define a downwardly diverging space.

The invention is not limited to the embodiments shown and described herein; many variants and modifications may be envisaged by those skilled in the art without departing from the spirit or scope of the invention as defined in the appended claims.

I claim:

1. An intermediary channel located between a combustion chamber for pulsatory combustion of a mixture of fuel and a combustive agent and an injection chamber for the injection of said mixture, comprising:

a heat tube wherein an internal wall of said intermediary channel and an outer surface of said heat tube define a recirculation zone for the recirculation of burned gases issuing from said combustion chamber, said recirculation zone being at least partially open at an upper end thereof;

and wherein said intermediary channel further comprises a lower portion located in the vicinity of the combustion chamber and an upper portion located in the vicinity of the injection chamber, said heat tube being located in said lower portion; and wherein said lower and upper portions are cylindrical, the lower portion having an inner diameter larger than an inner diameter of said upper portion, said upper and lower portions being connected to each other by a flange in front of which is located the upper end of said heat tube.

2. An intermediary channel according to claim 1, wherein said flange further comprises at a minimum diameter peripheral zone thereof a circular protrusion and wherein a diameter of a lowermost portion thereof is greater than the inner diameter of said heat tube.

3. An intermediary channel according to claim 2, wherein said circular protrusion is vertically oriented.

4. An intermediary channel according to claim 2, wherein said circular protrusion is inclined toward an inside portion of said heat tube.

5. An intermediary channel according to claim 2, wherein said circular protrusion is inclined outwardly of said heat tube.

6. An intermediary channel according to claim 3, which comprises at an upper portion thereof, a first cylindrical sleeve an outer diameter of which is smaller than an inner diameter of said heat tube and an lower edge of which forms said protrusion of said flange.

7. An intermediary channel according to claim 6, further comprising a jacket and at least one ring wherein said first cylindrical sleeve is maintained in place in said jacket integral with said combustion chamber by said at least one ring and wherein said at least one ring bears on an annular flat surface of said jacket.

8. An intermediary channel according to claim 7, wherein said at least one ring further comprises a first and second ring which define annular insulating spaces and which maintain said first cylindrical sleeve in position.

9. An intermediary channel according to claim 7, further comprising a second cylindrical sleeve wherein said first cylindrical sleeve is surrounded by said second cylindrical sleeve and wherein said first and second sleeves define an insulating jacket.

10. An intermediary channel according to claim 1, wherein said flange defines a downwardly diverging space.

11. An intermediary channel located between a combustion chamber for pulsatory combustion of a mixture of fuel and a combustive agent and an injection chamber for the injection of said mixture, comprising:

a heat tube wherein an internal wall of said intermediary channel and an outer surface of said heat tube define a recirculation zone for the recirculation of burned gases issuing from said combustion chamber, said recirculation zone being at least partially open at an upper end thereof; and wherein said heat tube is extended at a lower end thereof by at least one pad which extends toward the central portion of said combustion chamber.

* * * * *